US008018408B2

(12) United States Patent
Choi

(10) Patent No.: US 8,018,408 B2
(45) Date of Patent: Sep. 13, 2011

(54) ORGANIC LIGHT EMITTING DIODE DISPLAY

(75) Inventor: Sangmoo Choi, Yongin-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 904 days.

(21) Appl. No.: 12/000,992

(22) Filed: Dec. 19, 2007

(65) Prior Publication Data

US 2008/0150844 A1 Jun. 26, 2008

(30) Foreign Application Priority Data

Dec. 20, 2006 (KR) ..... 10-2006-0131182

(51) Int. Cl.
*G09G 3/32* (2006.01)

(52) U.S. Cl. ..... 345/82; 345/76; 345/77; 345/83; 345/84; 345/90; 345/92; 345/93

(58) Field of Classification Search ..... 345/76, 345/82, 77, 83, 84, 90, 92, 93
See application file for complete search history.

(56) References Cited

U.S. PATENT DOCUMENTS

| | | | |
|---|---|---|---|
| 7,414,599 | B2 | 8/2008 | Chung et al. |
| 7,429,985 | B2 | 9/2008 | Kimura et al. |
| 2005/0057459 | A1 | 3/2005 | Miyazawa |
| 2005/0237281 | A1 | 10/2005 | Tam |
| 2006/0044236 | A1 | 3/2006 | Kim |
| 2006/0107146 | A1 * | 5/2006 | Kim et al. ..... 714/727 |
| 2006/0262130 | A1 | 11/2006 | Kim et al. |
| 2007/0242016 | A1 | 10/2007 | Choi |

FOREIGN PATENT DOCUMENTS

| | | | |
|---|---|---|---|
| CN | 1 577 453 | A | 2/2005 |
| CN | 1 741 109 | A | 3/2006 |
| CN | 1 845 231 | A | 10/2006 |
| EP | 1 635 324 | A1 | 3/2006 |
| EP | 1 847 982 | A2 | 10/2007 |
| JP | 2003-202833 | A | 7/2003 |
| JP | 2005-031630 | A | 2/2005 |
| JP | 2005-009772 | | 4/2005 |
| JP | 2006-065286 | A | 3/2006 |
| JP | 2006-065328 | A | 3/2006 |
| JP | 2007-286572 | A | 11/2007 |
| KR | 10-2004-0034895 | A | 4/2004 |
| KR | 10-2006-0015812 | A | 2/2006 |
| KR | 10-2006-0018763 | A | 3/2006 |
| KR | 10-2006-0018764 | A | 3/2006 |

* cited by examiner

*Primary Examiner* — Richard Hjerpe
*Assistant Examiner* — Saifeldin Elnafia
(74) *Attorney, Agent, or Firm* — Lee & Morse, P.C.

(57) ABSTRACT

An OLED display having a plurality of scan lines and a plurality of data lines, an OLED adapted to emit images, a driving switching element adapted to supply the OLED with a driving current, a storage element having a first electrode and a second electrode, a first switching element having a first electrode, a control electrode and a second electrode, a second switching element having a control electrode adapted to be coupled to at least one of the plurality of scan lines and a third switching element having a control electrode adapted to be coupled to a previous scan line. The second switching element may be configured in a diode-like state connecting the driving switching element. The third switching element may be adapted to initialize a voltage stored in the storage element through at least one of the plurality of data lines.

18 Claims, 5 Drawing Sheets

ORGANIC LIGHT EMITTING DIODE DISPLAY

BACKGROUND OF THE INVENTION

1. Field of the Invention

Example embodiments relate to an organic light emitting diode (OLED) display and, more particularly, to an OLED display having a pixel initialized by a voltage supplied through a data line.

2. Description of the Related Art

An OLED display is a type of a flat panel display that uses an OLED to generate light. The light may be generated by combining electrons supplied by a cathode and holes supplied by an anode. Images may be realized on the OLED display by driving thin film transistors (TFT) formed at each pixel, which may supply the OLED with a driving current corresponding to a data signal. The OLED display may further include a plurality of pixels formed at an area where a plurality of scan lines, a plurality of emission control lines and a plurality of data lines intersect one another. Each pixel may include a pixel circuit for driving the pixel and may include the OLED to emit light according to the driving current of the pixel circuit. The pixel circuit may further include a driving switching element driven according to a data signal supplied by the data line, a storage element for storing a voltage between a source electrode of the driving switching element and a gate electrode and a plurality of switching elements.

The OLED may be driven through a pixel initializing period, a data writing period and a light emitting period. During the pixel initializing period, a previous data signal, which may be stored in the storage element, may be initialized to an initial voltage in response to a previous scan signal supplied through a previous scan line. During the data writing period, the voltage supplied by the data line in response to a current scan signal supplied through a current scan line may be stored in the storage element. During the light emitting period, the OLED may emit light according to the driving current that may flow through the driving switching element corresponding to the data signal stored in the storage element.

The pixel initializing period, however, may require an extra initial power source and an extra initial line (a line connected to an initial power source) to initialize the previous data signal stored in the storage element. The extra initial power source and the extra initial line may complicate the structure of the pixel circuit and may reduce an aperture ratio of the pixel. In addition, due to the increase number of data lines, there may be more integrated circuits to drive the OLED display and difficulty in maintaining a high resolution.

In order to manage the extra initial power source and the extra initial line, a demultiplexer (DeMux) may be used, which may have fewer output lines in the data driver. The DeMux may include a plurality of data supplying switching elements, which may be connected in common to the output line of the data driver. The respective data supplying switching elements may be coupled to a predetermined data line. Accordingly, the DeMux may supply the respective data line with the data signal in sequence by operating the data supplying switching elements.

The DeMux may further be driven by failing to initialize the previous data signal, in which case, a plurality of pixels may be coupled to each data line simultaneously by a current scan signal. Accordingly, the first pixel may be supplied with a current data signal and the next pixel may be supplied with a previous data signal. The previous data signal, however, may have a higher voltage level than the current data signal, which may reduce and/or prevent the supply of the current data signal to the respective pixel, because the driving switching element may be turned off. In addition, a time to charge the respective data line with the data signal may be decreased and the time during which the pixels are driven according to the scan signal may be decreased. As a result, the time to compensate a characteristic deviation of the driving switching element included in each pixel may be reduced and, thus, causing image quality to be non-uniform.

SUMMARY OF THE INVENTION

Example embodiments are therefore directed to an OLED display that substantially overcomes one or more of the problems due to the limitations and disadvantages of the related art.

It is therefore a feature of example embodiments to provide an OLED display having a pixel initialized by a voltage supplied through a data line so that an extra initial power source and an extra initial line may not be required, forming a simpler structure.

Another feature of example embodiments provides an OLED display having an improved aperture ratio.

Another feature of example embodiments provides an OLED display having an uniform image quality.

At least one of the above and other features of example embodiments may provide an OLED display having a plurality of scan lines and a plurality of data lines, an OLED adapted to emit images, a driving switching element adapted to supply the OLED with a driving current, a storage element having a first electrode and a second electrode, the first electrode may be adapted to be coupled to a control electrode of the driving switching element and the second electrode may be adapted to be coupled to a first power source, a first switching element having a first electrode adapted to be coupled to at least one of the plurality of data lines, a control electrode adapted to be coupled to at least one of the plurality of scan lines and a second electrode adapted to be coupled to a first electrode of the driving switching element, a second switching element having a control electrode adapted to be coupled to at least one of the plurality of scan lines, the second switching element may be configured in a diode-like state connecting the driving switching element, and a third switching element having a control electrode adapted to be coupled to a previous scan line, the third switching element may be adapted to be adapted to initialize a voltage stored in the storage element through at least one of the plurality of data lines.

The third switching element may include a first electrode adapted to be coupled to the storage element and a second electrode adapted to be coupled to at least one of the plurality of data lines. The driving switching element may include a first electrode adapted to be coupled to the first power source and a second electrode adapted to be coupled to a second power source.

The OLED may include an anode adapted to be coupled to the second electrode of the driving switching element and a cathode adapted to be coupled to the second power source. The OLED display may further include a fourth switching element adapted to be coupled between the second electrode of the driving switching element and the anode of the OLED, and a fifth switching element adapted to be coupled between the first electrode of the driving switching element and the first power source.

The second switching element may further include a first electrode and a second electrode. The first electrode of the second switching element may be adapted to be coupled between the control electrode of the driving switching element and the first electrode of the storing element, and the second electrode of the second switching element may be adapted to be coupled between the second electrode of the driving switching element and the first electrode of the fourth switching element. The first electrode of the driving switching element may be adapted to be coupled between the second electrode of the second switching element and a first electrode of the fifth switching element, and the second electrode of the may be adapted to be coupled to the first electrode of the fourth switching element. A control electrode of the fourth switching element may be adapted to be coupled to an emission control line to control an emission time of the OLED. A control electrode of the fifth switching element may be adapted to be coupled to the control electrode of the fourth switching element.

The fifth switching element may be adapted to transmit the first power source ELVDD to the first electrode of the driving switching element according to an emission control signal supplied from the emission control line.

The voltage stored in the storage element may be initialized by turning on the third switching element, and a data signal supplied from the data line may be stored in the storage element by turning on the first switching element and the second switching element.

The OLED display may further include a data driver adapted to be coupled to the plurality of data lines, a data output line adapted to be coupled between the plurality of data lines and the data driver and a DeMux adapted to be coupled between the plurality of data lines and the data output line. The DeMux may include an input port adapted to be coupled to the data output line and at least two output ports adapted to be coupled to the plurality of data lines. The DeMux may include at least two data supplying switching elements having a first electrode adapted to be coupled to the input port and a second electrode adapted to be coupled to the at least two output ports respectively.

The data signal may be adapted to be stored in the storage element while the data supplying switching elements is being turned on, and the data line may be adapted to be initialized as the data line is supplied with the initial data signal generated from the data driver. The driving switching element may be adapted to be in a diode-like state when the second switching element and the data supplying switching elements are turned on. The initial data signal may have a lower voltage level than a voltage difference between a voltage of the initial data signal and a threshold voltage of the driving switching element.

The OLED display may further include a pixel formed at an area where the plurality of scan lines, the plurality of data lines, and a plurality of emission control lines intersect, a scan driver adapted to be coupled to the plurality of scan lines, a data driver adapted to be coupled to the plurality of data lines, an emission control driver adapted to be coupled to the emission control line, and a DeMux driver adapted to be coupled between the plurality of data lines and the data driver. The pixel may be adapted to be initialized through the plurality of data lines.

The DeMux driver may further include an input port coupled to a data output line coupled to the data driver, and a plurality of DeMux having at least two output ports coupled to at least two data lines.

The data supplying switching elements may be adapted to be turned on in sequence after the first switching element and the second switching element are turned on.

BRIEF DESCRIPTION OF THE DRAWINGS

The above and other features and advantages of example embodiments will become more apparent to those of ordinary skill in the art by describing in detail example embodiments thereof with reference to the attached drawings, in which.

DETAILED DESCRIPTION OF THE INVENTION

Korean Patent Application No. 10-2006-0131182, filed on Dec. 20, 2006, in the Korean Intellectual Property Office, and entitled: "Organic Light Emitting Diodes Display," is incorporated by reference herein in its entirety.

Example embodiments will now be described more fully hereinafter with reference to the accompanying drawings; however, example embodiments may be embodied in different forms and should not be construed as limited to the embodiments set forth herein. Rather, these example embodiments are provided so that this disclosure will be thorough and complete, and will fully convey the scope of the invention to those skilled in the art.

Figure 1:
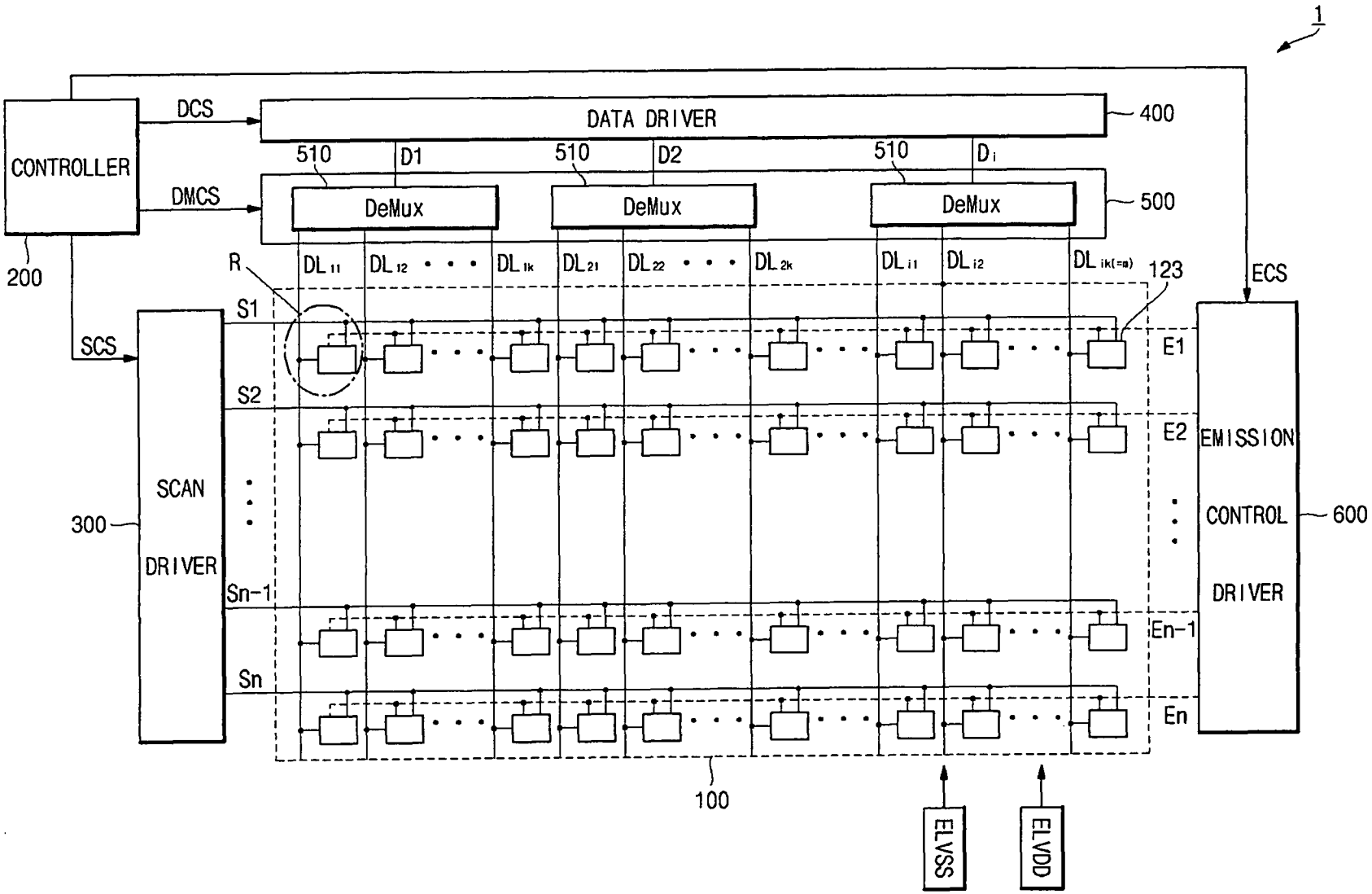
FIG. 1 illustrates a drawing depicting a schematic structure of an OLED display according to an example embodiment.

Referring to FIG. 1, an OLED display 1 may include an OLED display panel 100, a controller 200, a scan driver 300, a data driver 400, a DeMux driver 500 and an emission control driver 600.

The OLED display panel 100 may include a plurality of scan lines S1 to Sn, which may be arranged in a column direction, a plurality of emission control lines E1 to En, which may be arranged in the column direction, a plurality of data lines $DL_{11}$ to $DL_{ik(=m)}$, which may be arranged in a row direction and a plurality of pixels 123, which may be arranged in the row direction.

The pixels 123 may be formed at an area in which the scan lines S1 to Sn, the emission control lines E1 to En and the data lines $DL_{11}$ to $DL_{ik(=m)}$ intersect one another. The pixels 123 may emit light according to a data signal supplied from the data lines $DL_{11}$ to $DL_{ik(=m)}$. The pixels 123 may control the light in response to an emission time corresponding to an emission control signal supplied from the emission control lines E1 to En.

The controller 200 may generate a scan drive control signal (SCS), a data drive control signal (DCS), an emission control drive control signal (ECS) and a DeMux drive control signal (DMCS) corresponding to a synchronizing signal supplied from outside. The drive control signals SCS, DCS, DMCS and ECS may be supplied to the scan driver 300, the data driver 400, the DeMux driver 500 and the emission control driver 600, respectively.

The scan driver 300 may generate a scan signal responding to the scan drive control signal (SCS) and may supply the plurality of scan lines S1 to Sn with the scan signal in sequence. The OLED display panel 100 may select the pixel 123 according to the scan signal supplied from the scan driver 300.

The data driver 400 may generate a data signal for driving the pixels 123 responding to the data drive control signal (DCS) and may supply the plurality of data output lines D1 to Di with the data signal in sequence. The OLED display panel 100 may select the pixel 123 according to the data signal supplied from the data driver 400. The data driver 400 may further generate an initial data signal for initializing the pixels 123 and may supply the plurality of the data output lines D1 to Di with the initial data signal in sequence.

The DeMux driver 500 may respond to the DeMux drive control signal DMCS and may include a plurality of DeMuxs 510 for delivering the data signal (or the initial data signal) supplied from the data driver 400 to the data lines $DL_{11}$ to $DL_{ik(=m)}$. The DeMux driver 500 may include a same number of DeMuxs 510 as the number of data output lines D1 to Di. The respective DeMux 510 may supply k data lines DL with the data signal supplied from the data output lines D in sequence.

The emission control driver 600 may generate an emission control signal responding to the emission control driving control signal (ECS) and may supply the plurality of emission control lines E1 to En with the emission control signal in sequence. The OLED display panel 100 may select the pixel 123 according to the emission control signal supplied from the emission control driver 600.

The OLED display 1 may further include a first power source ELVDD and a second power source ELVSS. The first power source ELVDD and the second power source ELVSS may provide the pixels 123 with a voltage source and a reference voltage, respectively.

Figure 2:
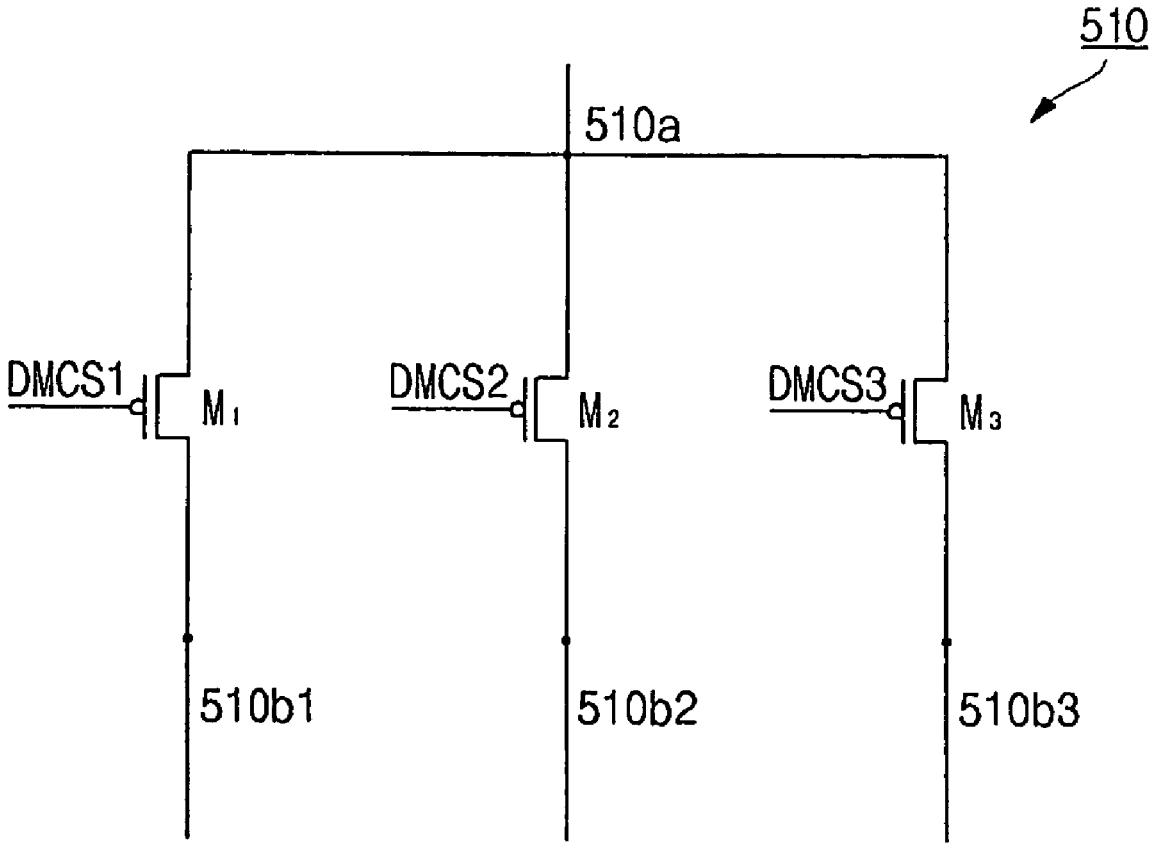
FIG. 2 illustrates a diagram of a driving circuit of a DeMux shown in FIG. 1.
Figure 3:
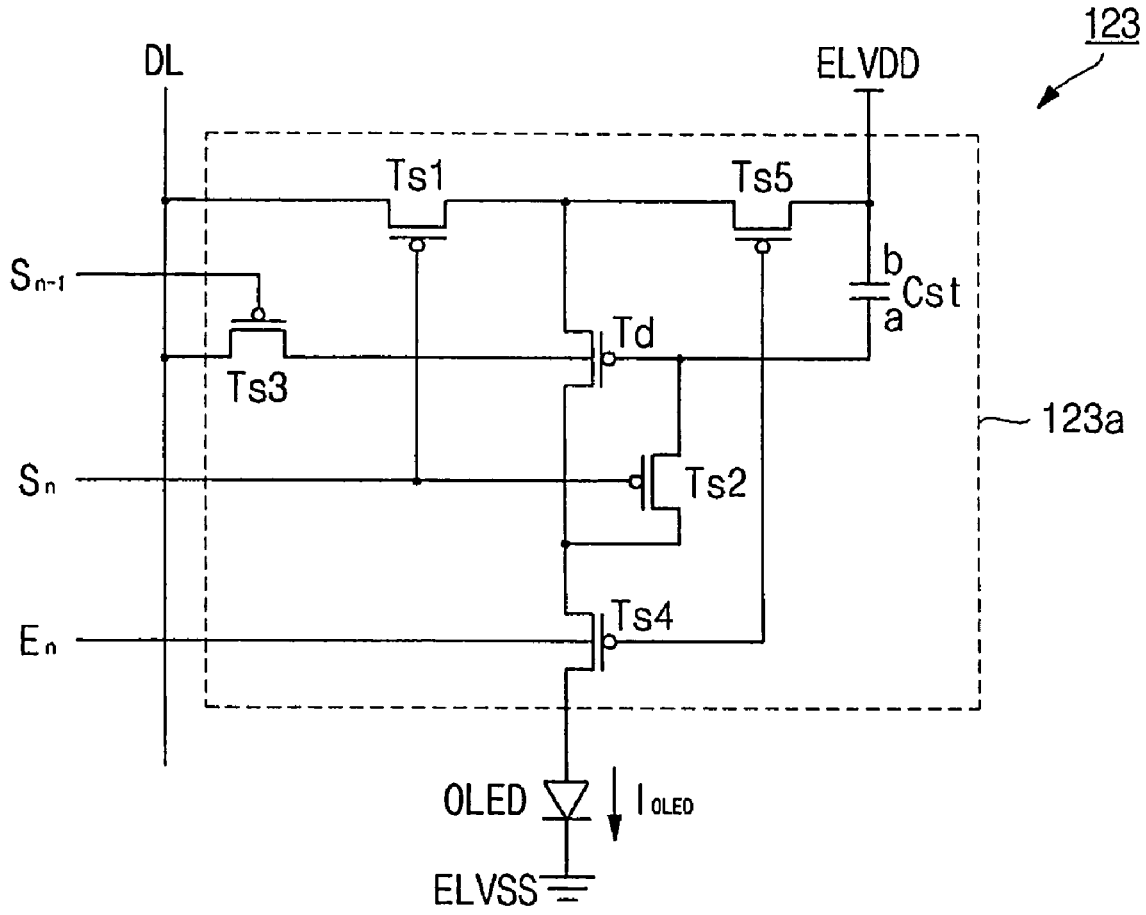
FIG. 3 illustrates a diagram of a driving circuit of a pixel shown in FIG. 1.
Figure 4:
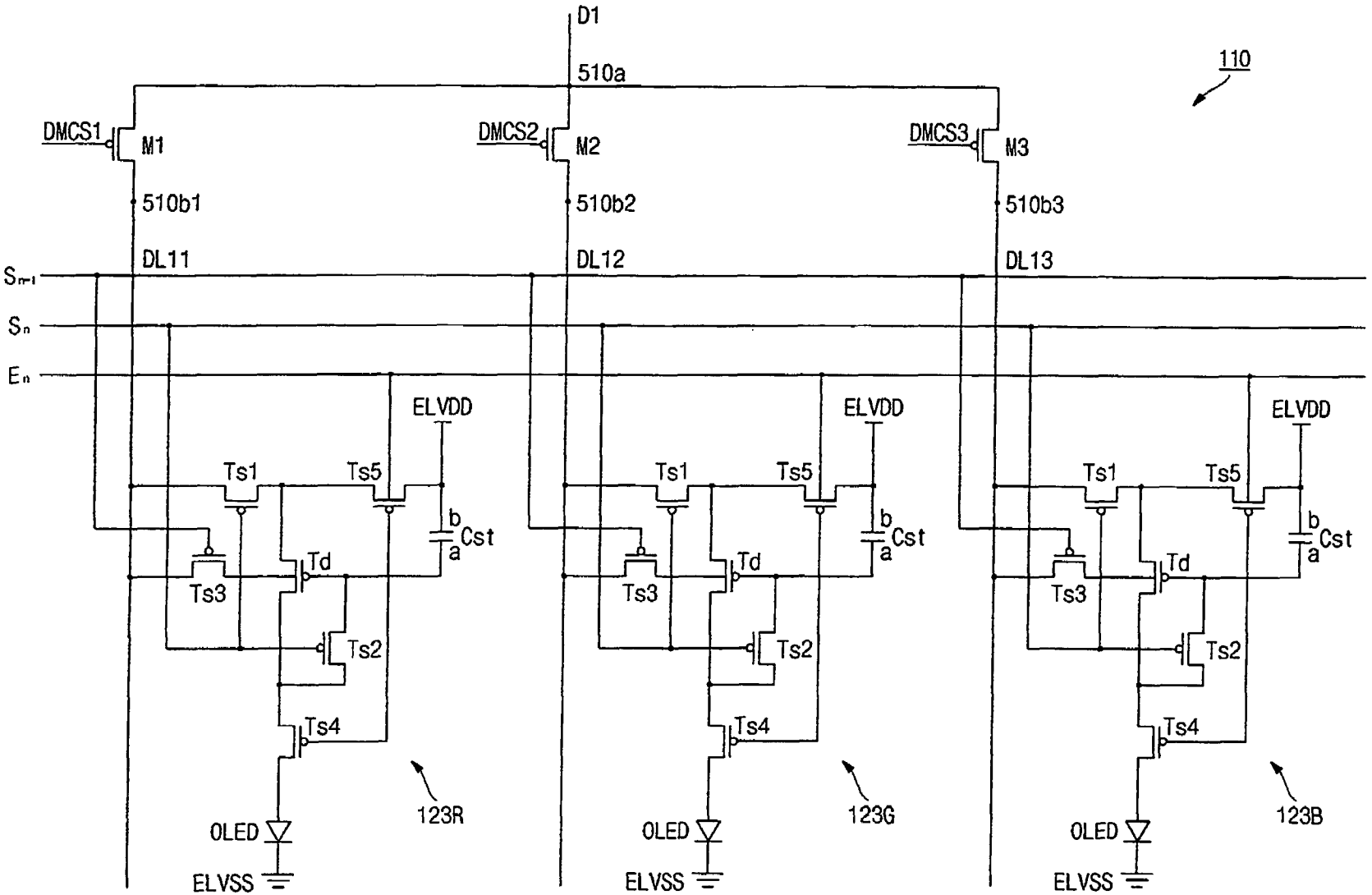
FIG. 4 illustrates a driving circuit of a relationship of the DeMux and the pixel.

FIG. 2 illustrates a diagram of a driving circuit of the DeMux 510 shown in FIG. 1; FIG. 3 illustrates a diagram of a driving circuit of the pixel 123 shown in FIG. 1; and FIG. 4 illustrates a diagram of a driving circuit 110 of a relationship of the DeMux 510 and the pixel 123.

Referring to FIG. 2, the driving circuit of the DeMux 510 may include an input port 510*a* coupled to the data output line D1 and output ports 510*b*1 to 510*b*3 coupled to the data lines DL11 to DL13. The driving circuit of the DeMux 510 may further include first to third data supplying switching elements M1, M2 and M3.

The input port 510*a* may be coupled to the data output line D1, e.g., one input port 510*a* may be connected to one data output line D1. The respective output port 510*b*1 to 510*b*3 may be coupled to the data lines DL11 to DL13. The respective output port 510*b*1 to 510*b*3 may supply the data lines DL11 to DL13 with the data signals delivered from the input port 510*a* in sequence according to an operation of the first to third data supplying switching elements M1, M2 and M3.

The respective data supplying switching elements M1, M2 and M3 may include a control electrode connected with the controller 200 (shown in FIG. 1), a first electrode (source or drain) connected to the input port 510*a* in common and a second electrode (drain or source) connected to the respective output port 510*b*1 to 510*b*3. The respective data supplying switching elements M1, M2 and M3 may be turned ON or OFF according to the DeMux drive control signals DMSC1, DMSC2 and DMSC3 supplied from the controller 200. When the first to third data supplying switching elements M1, M2 and M3 are turned ON, corresponding data signal may be supplied to the respective data line DL11 to DL13.

Referring to FIGS. 3 and 4, the driving circuit of the pixel 123 may correspond to pixels 123R, 123G, 123B, which may be coupled to the respective data line DL11 to DL13. The respective pixel 123R, 123G, 123B may be initialized through an initial data signal Ri, Gi and Bi supplied through the data lines DL11 to DL13. The driving circuit of the pixel 123 may further include the OLED, the scan line Sn and the pixel circuit 123*a* for emitting light connected to the data lines DL11 to DL13 and the emission control line En. The driving circuit of the pixel 123 may further include the first power source ELVDD and the second power source ELVSS.

The OLED may include an anode connected to the pixel circuit 123*a* and a cathode connected to the second power source ELVSS. The OLED may emit one of red, green or blue lights responding to a driving current IOLED supplied through the pixel circuit 123*a*. The OLED may be made of an organic material, e.g., fluorescent or phosphorescent.

The pixel circuit 123*a* may include a driving switching element Td to supply the OLED with the driving current IOLED, a storage element Cst and a plurality of switching elements, e.g., first to fifth switching elements Ts1, Ts2, Ts3, Ts4 and Ts5. The switching elements Td, Ts1, Ts2, Ts3, Ts4 and Ts5 may be a P-type field effect transistor (FET) or a N-type FET.

The driving switching element Td may include a first electrode (source or drain) connected with the first power source ELVDD, a second electrode (drain or source) connected with the anode of the OLED and a control electrode (or gate electrode), which may be operated by a voltage according to the data signal supplied from the data line DL. The driving switching element Td may distribute the driving current IOLED, which may correspond to the data signal supplied from the data line DL to the OLED display 1.

A first electrode of the storage element Cst may be connected with the control electrode (or gate electrode) of the driving switching element Td, and a second electrode of the storage element Cst may be connected with the first electrode (source or drain) of the first power source ELVDD. A voltage between the voltage of the first electrode (source or drain) of the driving switching element Td and the voltage of the control electrode (or gate electrode) of the driving switching element Td may be stored in the storage element Cst, so as to maintain the voltage of emitting light of the OLED. The pixel 123 may be driven according to the voltage stored in the storage element Cst. Further, during the initialization of any remaining voltage in the storage element, the pixel 123 may be initialized to a state where no scan signal is needed.

The first switching element Ts1 may include a first electrode (source or drain) connected with the data lines DL11 to DL13, a second electrode (drain or source) connected with the driving switching element Td and a control electrode (or gate electrode) connected to the scan line Sn. The first switching element Ts1 may supply the storage element Cst with the data signal supplied from the data lines DL11 to DL13.

The second switching element Ts2 may include a control electrode (or gate electrode) connected with the scan line Sn, a first electrode (source or drain) and a second electrode (drain or source). The second switching element Ts2 may be coupled between the control electrode (or gate electrode) of the driving switching element Td and the second electrode (drain or source) of the driving switching element Td. In other words, the second switching element Ts2 may be connected to the driving switching element Td in a diode-like state. The second switching element Ts2 may further store a threshold voltage of the driving switching element Td in the storage element Cst.

The third switching element Ts3 may include a control electrode (or gate electrode) connected to a previous scan line Sn−1, a first electrode (source or drain) connected to the data lines DL11 to DL13 and a second electrode (drain or source) connected to the control electrode (or gate electrode) of the driving switching element Td. The third switching element Ts3 may initialize the voltage stored in the storage element Cst through the data lines DL11 to DL13 according to the previous scan signal.

The fourth switching element Ts4 may include a first electrode (source or drain) connected with the second electrode (drain or source) of the driving switching element Td, a second electrode (drain or source) connected with the anode of the OLED and a control electrode (or gate electrode) connected with the emission control line En. The fourth switching element Ts4 may control driving time from the driving switching element Td to the OLED according to the emission control signal supplied from the emission control line En. This may result in obtaining the emission time of the OLED.

The fifth switching element Ts5 may include a first electrode (source or drain) connected to the first power source ELVDD, a second electrode (drain or source) connected to the first electrode (source or drain) of the driving switching element Td and a control electrode (or gate electrode) connected to the emission control line En. The fifth switching element Ts5 may deliver the first power source ELVDD to the first electrode (source or drain) of the driving switching element Td according to the emission control signal supplied from the emission control line En.

The first power source ELVDD and the second power source ELVSS may supply a voltage source and a reference voltage, respectively, for driving the pixels 123. Further, the voltage supplied by the second power source ELVSS may be formed to have a lower voltage level than the voltage supplied by the first power source ELVDD. The second power source ELVSS may be a ground voltage or a negative voltage.

Now, an operation of the OLED display 1 according to example embodiments will be described in detail. More particularly, the operation of the driving circuits of the DeMux 510 and the pixels 123.

Figure 5:
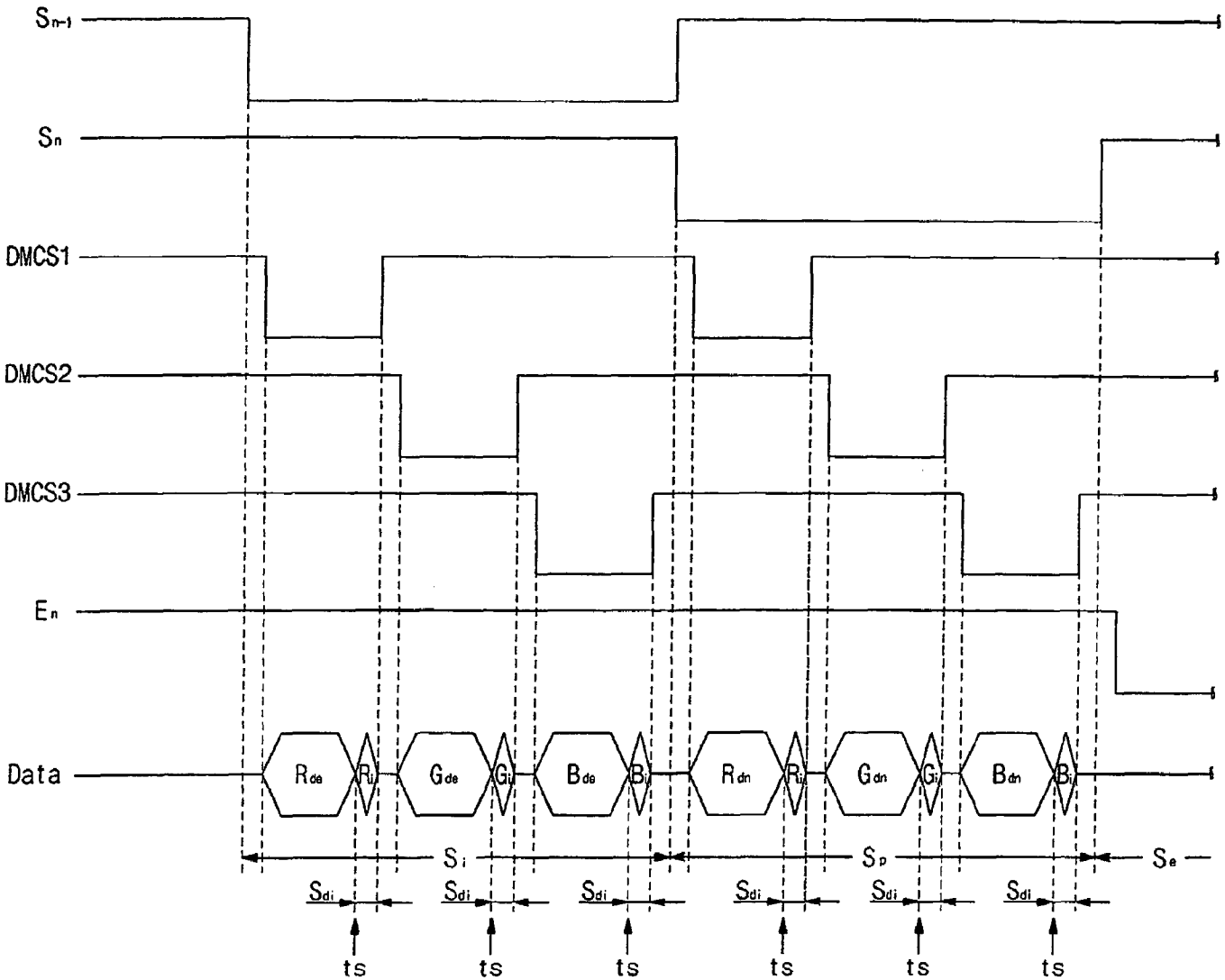
FIG. 5 illustrates a diagram of a driving waveform supplied through the driving circuit of FIG. 4.

FIG. 5 illustrates a diagram of a driving waveform supplied through the driving circuit 110 of FIG. 4. Referring to FIG. 5, the OLED display 1 according to example embodiments may be driven through an initializing period Si, a data programming period Sp and a light emitting period Se. The respective pixels 123R, 123G, 123B may be initialized by voltages supplied to the data lines DL11 to DL13 through the initializing period Si. The pixels 123R, 123G, 123B may further be supplied with current data signals Rdn, Gdn and Bdn in sequence via the respective data line DL11 to DL13 during the data programming period Sp. The data lines DL11 to DL13 may be initialized through the respective data line initializing period Sdi.

The initializing period Si may further initialize the pixels 123R, 123G and 123B via the previous scan signal supplied from the previous scan line Sn−1. During the initializing period Si (while the previous scan line Sn−1 is being supplied with a previous scan signal of low level), the third switching element Ts3 is turned ON. Accordingly, when the current data signals Rdn, Gdn and Bdn are stored in the previous scan line Sn−1, the remaining voltage in the storage element Cst may be initialized through the data lines DL11 to DL13, which may pass through the third switching element Ts3. Further, during the initializing period Si, the voltage level of the data lines DL11 to DL13 may be determined to have a lower voltage level than a threshold voltage level. The threshold voltage level of the driving switching element Td may be subtracted from the lowest voltage level of the current data signals Rdn, Gdn and Bdn supplied during the data programming period Sp.

The data programming period Sp may supply the respective pixel 123R, 123G and 123B with the current data signals Rdn, Gdn and Bdn via the current scan signal supplied from the scan line Sn. During the data programming period Sp (while the current scan line Sn is supplied with the current scan signal of low level), the first switching element Ts1 and the second switching element Ts2 is turned ON. The control electrode of the first to third data supplying switching elements M1, M2 and M3 may be supplied with the driving control signals DMCS1 to DMCS3 in sequence and, thereafter, the first to third data supplying switching elements M1, M2 and M3 may be turned ON in sequence.

When the first data supplying switching elements M1 is turned ON, the data signal Rdn may be stored in the storage element Cst passing through the driving switching element Td of the red pixel 123R at the data line DL11. Further, when the second data supplying switching elements M2 is turned ON, the data signal Gdn may be stored in the storage element Cst passing through the driving switching element Td of the green pixel 123G at the data line DL12. Even further, when the third data supplying switching elements M3 is turned ON, the data signal Bdn may be stored in the storage element Cst passing through the driving switching element Td of the blue pixel 123B at the data line DL13.

The supply of the current data signals Rdn, Gdn and Bdn, however, may be impeded when previous data signals Rde, Gde and Bde remain at the respective data line DL11 to DL13, while the first to third data supplying switching elements M1, M2, M3 are turned ON in sequence. For example, when a current data signal Rdn is supplied to the red pixel 123R, the first and second switching elements Ts1 and Ts2 may be turned ON. Therefore, the green pixel 123G and the blue pixel 123B may be coupled to the data lines DL12 and DL13. The green pixel 123G and the blue pixel 123B may be supplied with the previous data signals Gde and Bde via the first and the second switching elements Ts1 and Ts2. Further, if the respective previous data signals Gde and Bde have a relatively low voltage level compared with the current data signals Gdn and Bdn, the current data signals Gdn and Bdn may be properly stored. Alternatively, if the previous data signals Gde and Bde have a higher voltage level than the current data signals Gdn and Bdn, the current data signals Gdn and Bdn may not be properly stored due to the structure of the respective pixels 123G and 123B, e.g., a diode-like connection of the driving switching element Td. The red pixel 123R may be affected in the same manner as the green and blue pixels 123G and 123B as mentioned above. However, the affect of the previous data signal Rde in the red pixel 123R may be relatively small because the interval between a supply of the current scan signal and a supply of the current data signal Rdn in the red pixel 123R is smaller than in the case of the green pixel 123G and the blue pixel 123B. Accordingly, in order to affect the previous data signal Rde, the driving circuit of the pixel 123 may employ the data line initializing period Sdi so that the data lines DL11 to DL13 may be initialized by lowering the voltage level of the data lines DL11 to DL13 during the data programming period Sp. The respective data line initializing period Sdi may progress at a point of time (ts), e.g., after the pixels 123R, 123G and 123B are supplied with the current data signals Rdn, Gdn and Bdn through the respective data line DL11 to DL13. Further, the respective data line DL11 to DL13 may be initialized while the first to third data supplying switching elements M1, M2 and M3 are being turned ON. Further, the respective data line DL11 to DL13 may be supplied with the initial data signals Ri, Gi and Bi from the data driver 400 during the data line initializing period Sdi. The initial data signals Ri, Gi and Bi may initialize the data lines DL11 to DL13, and may be simultaneously supplied to the respective pixel 123R, 123G and 123B. The initial data signals Ri, Gi and Bi may then initialize the voltage stored in the storage element Cst, which may be included in the respective pixel 123R, 123G and 123B. Further, the voltage level of the initial data signal Ri, Gi and Bi may be determined to have a lower voltage level than the threshold voltage level of the driving switching element Td. The threshold voltage level of the driving switching element Td may be subtracted from the lowest voltage level of the current data signals Rdn, Gdn and Bdn supplied during the data programming period Sp. Thus, the current data signals Rdn, Gdn and Bdn may be maintained because the respective pixel 123R, 123G and 123B may be connected in a diode-like state with the driving switching element Td, even if the data lines DL11 to DL13 are supplied with the initial data signals Ri, Gi and Bi.

The light emitting period Se may be a period for the OLED to emit light according to the emission control signal supplied from the emission control line En. During the light emitting period Se, the fourth switching element Ts4 and the fifth switching element Ts5 may be turned ON when the emission control signal of the respective pixel 123R, 123G and 123B is at a low level. Therefore, the driving switching element Td may be connected with the OLED through the fourth switching element Ts4. Further, the first electrode of the driving switching element Td may be supplied with the first power source ELVDD through the fifth switching element Ts5. As a result, the OLED may emit light corresponding to the driving current IOLED, which may respond to the difference of the voltage between the first electrode (source or drain) of the switching device Td and the control electrode (or gate electrode) of the driving switching element Td.

Because the pixels 123R, 123G and 123B may be initialized by the voltage supplied from the respective data line DL11 to DL13 during the initializing period Si, an extra initial line may not be required. Further, a structure of the pixel circuit may be simpler and, thus, an aperture ratio is improved. That is, the remaining voltage in the storage element Cst may be initialized through the data lines DL11 to DL13 so that the remaining voltage may supply the current data signals Rdb, Gdn and Bdn and, thus, extra initial power sources and initial lines are not required.

Further, the current data signals Rdn, Gdn and Bdn may be stored in the storage element Cst included in the respective pixels 123R, 123G and 123B using the DeMux 510 during the data programming period Sp. The data lines DL11 to DL13 may then be initialized as the data driver 400 supplies the data lines DL11 to DL13 with the initial data signals Ri, Gi and Bi during the data line initializing period Sdi. Accordingly, the driving time of the pixels 123R, 123G and 123B and the charging time for charging the respective data lines DL11 to DL13 with the current data signals Rdn, Gdn and Bdn may each be longer. Further, the driving time of the pixels 123R, 123G and 123B according to the scan signal may also be longer. As a result, uniformity of the image quality may be improved.

Further, the OLED display 1 may supply the respective data lines DL11 to DL13 with the current data signals Rdn, Gdn and Bdn while the current scan line Sn is being supplied with the scan signal. Accordingly, the respective pixels 123R, 123G and 123B may supply the current data signals Rdn, Gdn and Bdn without being affected by the previous data signals Rde, Gde and Bde because the data lines DL11 to DL13 may be initialized by the initial data signals Ri, Gi and Bi before the first to third data supplying switching elements M1, M2 and M3 are turned OFF. As such, there may be no requirement to separate the actual driving time of the pixels 123R, 123G and 123B and the charging time of the current data signals Rdn, Gdn and Bdn. This may provide longer charging time of the current data signals Rdn, Gdn and Bdn and driving time of the pixels 123R, 123G and 123B. In addition, a time for compensating a characteristic deviation of the driving switching element Td included in the pixels 123R, 123G and 123B may be longer and, thus, the uniformity of the pixels 123R, 123G and 123B may be improved.

Although the above example embodiments described the DeMux connected to the first data output line and the pixels connected to the DeMux, other configurations may be employed. For example, the DeMux may be connected to another data output line included in the DeMux driver and the pixels connected to the DeMux.

In other example embodiments, the number of pixels connected to the DeMux may not be limited to the red pixel, the green pixel and the blue pixel being connected to one DeMux (e.g., k is 3), and that other various modifications may be made according to the need of those of ordinary skill in the art.

It will be understood that when an element is referred to as being "on" another element, it can be directly on the other element or intervening elements may also be present. In contrast, when an element is referred to as being "directly on," "directly connected to" or "directly coupled to" another element, there are no intervening elements present. Further, it will be understood that when an element is referred to as being "under" or "above" another element, it can be directly under or directly above, and one or more intervening elements may also be present. In addition, it will also be understood that when an element is referred to as being "between" two elements, it can be the only elements between the elements, or one or more intervening elements may also be present. Further, when it is described that a device "includes" a constituent element, it means that the device may further include other constituent elements in addition to the element unless specifically referred to the contrary. Like numbers refer to like elements throughout.

It will also be understood that the terms "first," "second," etc. may be used herein to describe various elements, and should not be limited by these terms. These terms are only used to distinguish an element from another element. Thus, a first element discussed herein could be termed a second element without departing from the teachings of example embodiments.

Example embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of example embodiments as set forth in the following claims.

What is claimed is:

1. An organic light emitting diodes (OLED) display, comprising:

a plurality of scan lines and a plurality of data lines;

an OLED adapted to emit images;

a driving switching element adapted to supply the OLED with a driving current;

a storage element having a first electrode and a second electrode, the first electrode is adapted to be coupled to a control electrode of the driving switching element and the second electrode is adapted to be coupled to a first power source;

a first switching element having a first electrode adapted to be coupled to at least one of the plurality of data lines, a control electrode adapted to be coupled to at least one of the plurality of scan lines and a second electrode adapted to be coupled to a first electrode of the driving switching element;

a second switching element having a control electrode adapted to be coupled to at least one of the plurality of scan lines, the second switching element is configured in a diode-like state connecting the driving switching element; and a third switching element having a first electrode adapted to be coupled to the storage element, a second electrode adapted to be coupled to at least one of the plurality of data lines, and a control electrode adapted to be coupled to a previous scan line, the third switching element is adapted to initialize a voltage stored in the storage element through at least one of the plurality of data lines.

2. The OLED display as claimed in claim 1, wherein the driving switching element includes a first electrode adapted to be coupled to the first power source and a second electrode adapted to be coupled to a second power source.

3. The OLED display as claimed in claim 2, wherein the OLED includes an anode adapted to be coupled to the second electrode of the driving switching element and a cathode adapted to be coupled to the second power source.

4. The OLED display as claimed in claim 2, further comprising:

a fourth switching element adapted to be coupled between the second electrode of the driving switching element and the anode of the OLED; and a fifth switching element adapted to be coupled between the first electrode of the driving switching element and the first power source.

5. The OLED display as claimed in claim 4, wherein the second switching element further comprises a first electrode and a second electrode, the first electrode of the second switching element is adapted to be coupled between the control electrode of the driving switching element and the first electrode of the storing element, and the second electrode of the second switching element is adapted to be coupled between the second electrode of the driving switching element and the first electrode of the fourth switching element.

6. The OLED display as claimed in claim 4, wherein the first electrode of the driving switching element is adapted to be coupled between the second electrode of the first switching element and a first electrode of the fifth switching element, and the second electrode of the driving switching element is adapted to be coupled to the first electrode of the fourth switching element.

7. The OLED display as claimed in claim 4, wherein a control electrode of the fourth switching element is adapted to be coupled to an emission control line to control an emission time of the OLED.

8. The OLED display as claimed in claim 7, wherein a control electrode of the fifth switching element is adapted to be coupled to the control electrode of the fourth switching element.

9. The OLED display as claimed in claim 1, wherein the voltage stored in the storage element is initialized by turning on the third switching element, and a data signal supplied from the data line is stored in the storage element by turning on the first switching element and the second switching element.

10. The OLED display as claimed in claim 9, further comprising:

a data driver adapted to be coupled to the plurality of data lines;

a data output line adapted to be coupled between the plurality of data lines and the data driver; and a demultiplexer adapted to be coupled between the plurality of data lines and the data output line, wherein the demultiplexer includes an input port adapted to be coupled to the data output line and at least two output ports adapted to be coupled to the plurality of data lines.

11. The OLED display as claimed in claim 10, wherein the demultiplexer includes at least two data supplying switching elements having a first electrode adapted to be coupled to the input port and a second electrode adapted to be coupled to the at least two output ports respectively.

12. The OLED display as claimed in claim 11, wherein the data signal is adapted to be stored in the storage element while the data supplying switching elements is being turned on, and the data line is adapted to be initialized as the data line is supplied with the initial data signal generated from the data driver.

13. The OLED display as claimed in claim 12, wherein the driving switching element is adapted to be in a diode-like state when the second switching element and the data supplying switching elements are turned on.

14. The OLED display as claimed in claim 13, wherein the initial data signal has a lower voltage level than a voltage difference between the voltage of the initial data signal and a threshold voltage of the driving switching element.

15. The OLED display as claimed in claim 1, further comprising:

a pixel formed at an area where the plurality of scan lines, the plurality of data lines, and a plurality of emission control lines intersect;

a scan driver adapted to be coupled to the plurality of scan lines;

a data driver adapted to be coupled to the plurality of data lines;

an emission control driver adapted to be coupled to the plurality of emission control lines; and a demultiplexer driver adapted to be coupled between the plurality of data lines and the data driver, wherein the pixel being initialized through the plurality of data lines.

16. The OLED display as claimed in claim 15, wherein the demultiplexer driver further comprising:

an input port adapted to be coupled to a data output line coupled to the data driver; and a plurality of demultiplexers having at least two output ports adapted to be coupled to at least two data lines.

17. The OLED display as claimed in claim 16, wherein the demultiplexer driver includes a same number of demultiplexers as a number of data output lines.

18. The OLED display as claimed in claim 16, wherein the data supplying switching elements is adapted to be turned on in sequence after the first switching element and the second switching element are turned on.

* * * * *